United States Patent [19]

Hanamoto et al.

[11] Patent Number: 4,474,153

[45] Date of Patent: Oct. 2, 1984

[54] IDLING SPEED CONTROLLING SYSTEM FOR INTERNAL COMBUSTION ENGINE

[75] Inventors: Masato Hanamoto; Koso Iida; Akio Inoue; Yukinari Imoto, all of Hiroshima, Japan

[73] Assignee: Toyo Kogyo Co., Ltd., Hiroshima, Japan

[21] Appl. No.: 433,431

[22] Filed: Oct. 8, 1982

[30] Foreign Application Priority Data

Oct. 9, 1981 [JP] Japan ..... 56-161164

[51] Int. Cl.[3] ..... F02M 3/00

[52] U.S. Cl. ..... 123/339; 123/360; 123/587; 74/860

[58] Field of Search ..... 123/339, 587, 360; 74/860

[56] References Cited

U.S. PATENT DOCUMENTS

| | | | |
|---|---|---|---|
| 3,661,131 | 5/1972 | Croft . | |
| 4,240,145 | 12/1980 | Yano et al. | 123/587 |
| 4,344,398 | 8/1982 | Ikeura | 123/339 |
| 4,363,303 | 12/1982 | Takayama | 123/339 |
| 4,365,599 | 12/1982 | Ikeura | 123/587 |
| 4,367,708 | 1/1983 | Nakamura et al. | 123/339 |
| 4,401,073 | 8/1983 | Furuhashi | 74/860 |
| 4,406,262 | 9/1983 | Ikeura | 123/339 |

FOREIGN PATENT DOCUMENTS

| | | | |
|---|---|---|---|
| 3931 | 12/1977 | Japan . | |
| 137234 | 1/1980 | Japan . | |
| 153834 | 1/1980 | Japan . | |
| 160138 | 12/1980 | Japan | 123/339 |

*Primary Examiner*—Parshotam S. Lall

*Attorney, Agent, or Firm*—Gerald J. Ferguson, Jr.; Joseph J. Baker

[57] ABSTRACT

Feedback control is carried out to maintain the rotational speed of an internal combustion engine during idling at a desirable speed determined according to the operating conditions of the engine by controlling an adjusting valve for controlling the amount of air to be fed to the engine. The actual rotational speed of the engine and the actual opening angle of the throttle valve are detected and when the actual rotational speed is lower than a predetermined value and at the same time the actual opening angle of the throttle valve is smaller than a predetermined value, the feedback control is carried out. Further, whether or not the driving power of the engine is operatively transmitted to the driving wheels is detected, and the predetermined value for the rotational speed of the engine is set at a higher value when the driving power is not transmitted to the driving wheels than when the driving power is transmitted to the driving wheels.

10 Claims, 10 Drawing Figures

IDLING SPEED CONTROLLING SYSTEM FOR INTERNAL COMBUSTION ENGINE

BACKGROUND OF THE INVENTION

1. Field of the Invention

This invention relates an idling speed controlling system for an internal combustion engine.

2. Description of the Prior Art

Generally it is preferred to maintain the idling speed of the internal combustion engine of a vehicle at a low speed of about 600 to 700 rpm from the viewpoint of fuel consumption and stability of the combustion in the engine. In unexamined Japanese Utility Model Publication 55(1980)-137234 is disclosed a feedback control system for controlling the idling speed of an engine in which the throttle valve is opened and closed under control so as to maintain the idling speed constant.

This prior art system carries out the feedback control when it is detected that the throttle valve is in the idling position. However, the throttle valve may be in idling position even when the engine is operating at high rotational speed as in a case where the braking effort of the engine is being used to slow the vehicle and at these times it is not preferred to carry out feedback control as if the engine were actually idling. Thus, there has been proposed a feedback control system for controlling the idling speed in which the actual idling speed is compared with a desired idling speed determined according to the operating conditions of the engine, and a control valve for controlling the amount of air to be fed to the engine is adjusted to equalize the actual idling speed to the desired idling speed according to the result of the comparison. In this system, the engine is considered to be idling when the actual opening angle of the throttle valve is smaller than a predetermined value and at the same time the actual rotational speed of the engine is lower than a predetermined value, and the feedback control is carried out to equalize the actual rotational speed to said desired idling speed. This system is disadvantageous in that if the predetermined value of the rotational speed below which the engine is considered to be idling (this value will be referred to as the "reference idling speed" hereinbelow) is set at a low value, there is the possibility of engine's stalling due to delay in the control system since the control system does not operate until the rotational speed of the engine is substantially lowered, while if the reference idling speed is set at a high value, the braking effect of the engine brake will be reduced since the engine is considered to be idling and the control valve is opened while the vehicle is still running due to premature operation of the control system.

SUMMARY OF THE INVENTION

In view of the foregoing observations and description, the primary object of the present invention is to provide an improved idling controlling system for an internal combustion engine in which the idling speed of the engine is effectively controlled without causing stalling of the engine even if the rotational speed of the engine is abruptly lowered as is often the case after racing, and at the same time without reducing the braking effect of the engine.

In accordance with the present invention, the actual rotational speed of the engine and the actual opening angle of the throttle valve are detected, and at the same time it is detected whether or not the driving power of the engine is transmitted to the driving wheels. When the opening angle of the throttle valve becomes smaller than a predetermined value and at the same time the rotational speed of the engine becomes lower than the reference idling speed set at a higher value when the driving power is not transferred to the driving wheels than when the driving power is transmitted to the same, control is carried out to equalize the actual idling speed to a desired idling speed determined according to the operating conditions of the engine.

Thus in the idling controlling system of the present invention, when the driving power is not transmitted to the driving wheels and there is the possibility of the engine's stalling if the rotational speed thereof should be abruptly lowered, the control is carried out before the rotational speed is lowered to such extent as to cause stalling of the engine, whereby stalling of the engine can be effectively prevented, while when the driving power is transferred to the driving wheels and there is hardly any possibility of the engine's stalling, the control is not carried out until the rotational speed of the engine is sufficiently lowered, whereby reduction of the braking effect of the engine due to premature operation of the system is prevented.

The present invention can be carried out either in the form of a system in which the idling speed of the engine is controlled by controlling the throttle valve itself or in the form of a system in which the idling speed is controlled by controlling a bypass valve for adjusting the amount of air to be fed to the engine through a bypass passage which bypasses the throttle valve.

DESCRIPTION OF THE PREFERRED EMBODIMENT

Figure 1:
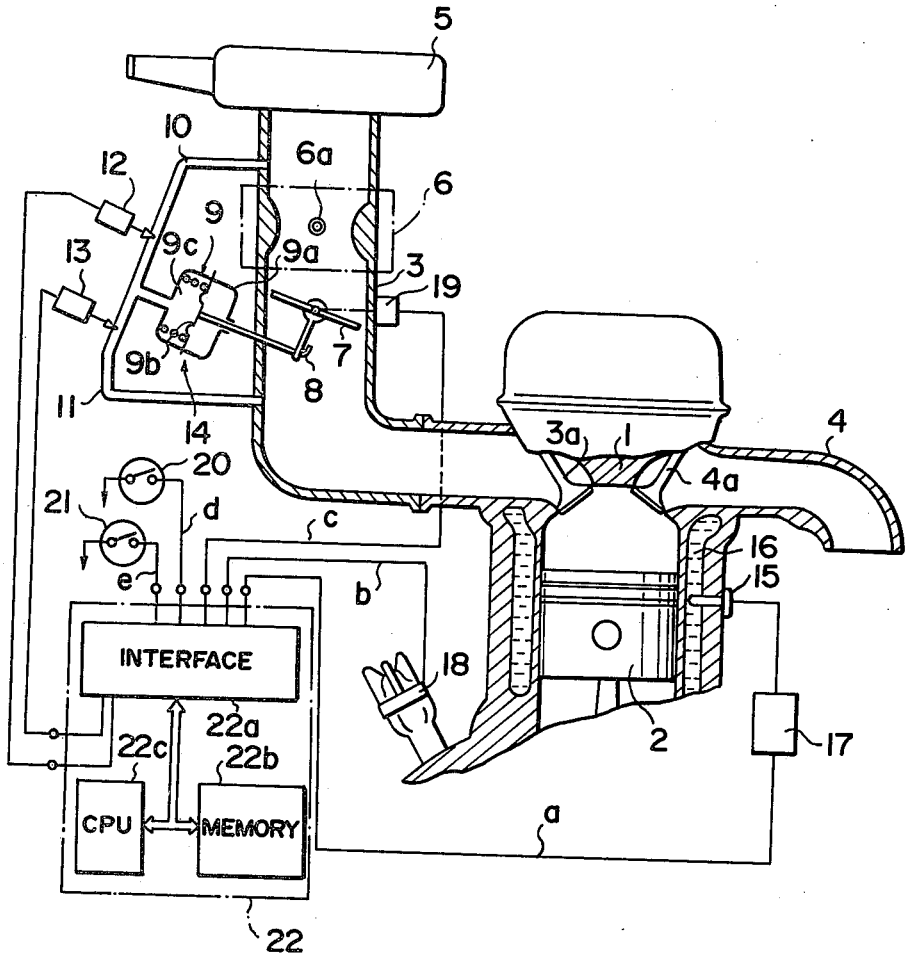
FIG. 1 is a schematic view of an internal combustion engine employing an idling speed controlling system in accordance with an embodiment of the present invention.

In FIG. 1 an internal combustion engine 1 has a piston 2, an intake manifold 3, an intake valve 3*a*, an exhaust manifold 4 and an exhaust valve 4*a*. On the top end of the intake manifold 3 is mounted an air cleaner 5 for filtering the air taken into the intake manifold 3, and a caburettor 6 is provided in the intake manifold 3 below the air cleaner 5. A fuel nozzle 6*a* of the caburettor 6 opens into the intake manifold 3. A throttle valve 7 is disposed just below or just downstream of the caburettor 6 to control the amount of air fed to the combustion engine 1. The throttle valve 7 is controlled by an actuator 14 including a stopper 8 which is engaged with the throttle valve 7 to open and close it. The stopper 8 is driven by a diaphragm unit 9 comprising a casing 9*a* and a diaphragm 9*b* which is mounted in the casing 9*a* to divide the internal space thereof into two chambers, whereby a vacuum chamber 9*c* is formed on the side of the diaphragm 9*b* remote from the stopper 8. The stopper 8 is connected to the diaphragm 9*b* at its end remote from the throttle valve 7 to move together therewith. A first passage 10 connects the vacuum chamber 9*c* to the space in the intake manifold 3 upstream of the throttle valve 7 which is substantially at atmospheric pressure, while a second passage 11 connects the vacuum chamber 9*c* to the space in the induction manifold 3 downstream of the throttle valve 7 which is at a negative pressure. First and second solenoid valves 12 and 13 are provided to open and close the respective passages 12 and 13.

A water temperature sensor 15 detects the temperature of cooling water 16. The output of the sensor 15 is inputted into an A/D converter 17 which converts the analogue signal output of the sensor 16 into a digital signal. The output of the A/D converter 17, or a water temperature signal a is inputted into an interface 22*a* of an actuator controlling device 22 which will be described hereinbelow. A distributor 18 contains therein a rotational speed detector (an electromagnetic pick-up device) for detecting the rotational speed of the combustion engine 1 the output of which is inputted into the interface 22*a* of the actuator controlling device 22 as a rotational speed signal b. A throttle position sensor 19 detects the opening angle of the throttle valve 7 and delivers a throttle opening angle signal c to the interface 22*a*. A cooler load signal d which is the output of a cooler switch 20 is further inputted into the interface 22*a*. A driving power transmission detecting switch 21 detects whether or not the driving power of the engine 1 is transmitted to the driving wheels. The driving power connection detecting switch 21 will be described in more detail referring to FIG. 6 hereinafter. In this specification, the driving power is defined as being in a non-transmitted state when the driving power of the engine 1 is not operatively transmitted to the driving wheels, e.g., when the gear-shift lever is in N or P position in the case of automatic transmission type cars, or when the gear-shift lever is in neutral and/or the clutch is disconnected in case of manual transmission type cars. On the other hand, the driving power is defined as being in the transmitted state when the driving power of the engine 1 is operatively transmitted to the driving wheels, e.g., when the gear-shift lever is in one of the D, 1, 2 and R positions in case of automatic transmission type cars, or when the gear-shift lever is in any position other than neutral and at the same time the clutch is engaged in case of manual transmission type cars. The driving power transmission detecting switch 21 delivers to the interface 22*a* a power transmission signal e which, for example, is "1" when the driving power is in the non-transmitted state and is "0" when the driving power is in the transmitted state.

The actuator controlling device 22 is in the form of a microcomputer comprising the interface 22*a*, a memory 22*b* and a CPU (Central Processing Unit) 22*c*, and compares the actual idling speed detected by the rotational speed detector with a desired idling speed which is determined according to the operating condition of the engine 1 to determine a target opening angle of the throttle valve 7 according to the difference therebetween. At the same time, the actuator controlling device 22 compares the actual opening angle of the throttle valve 7 detected by the throttle position sensor 19 with the target opening angle of the valve 7 and controls the actuator 14 according to the difference therebetween so that the actual idling speed is equalized to the desired idling speed.

Figure 2:
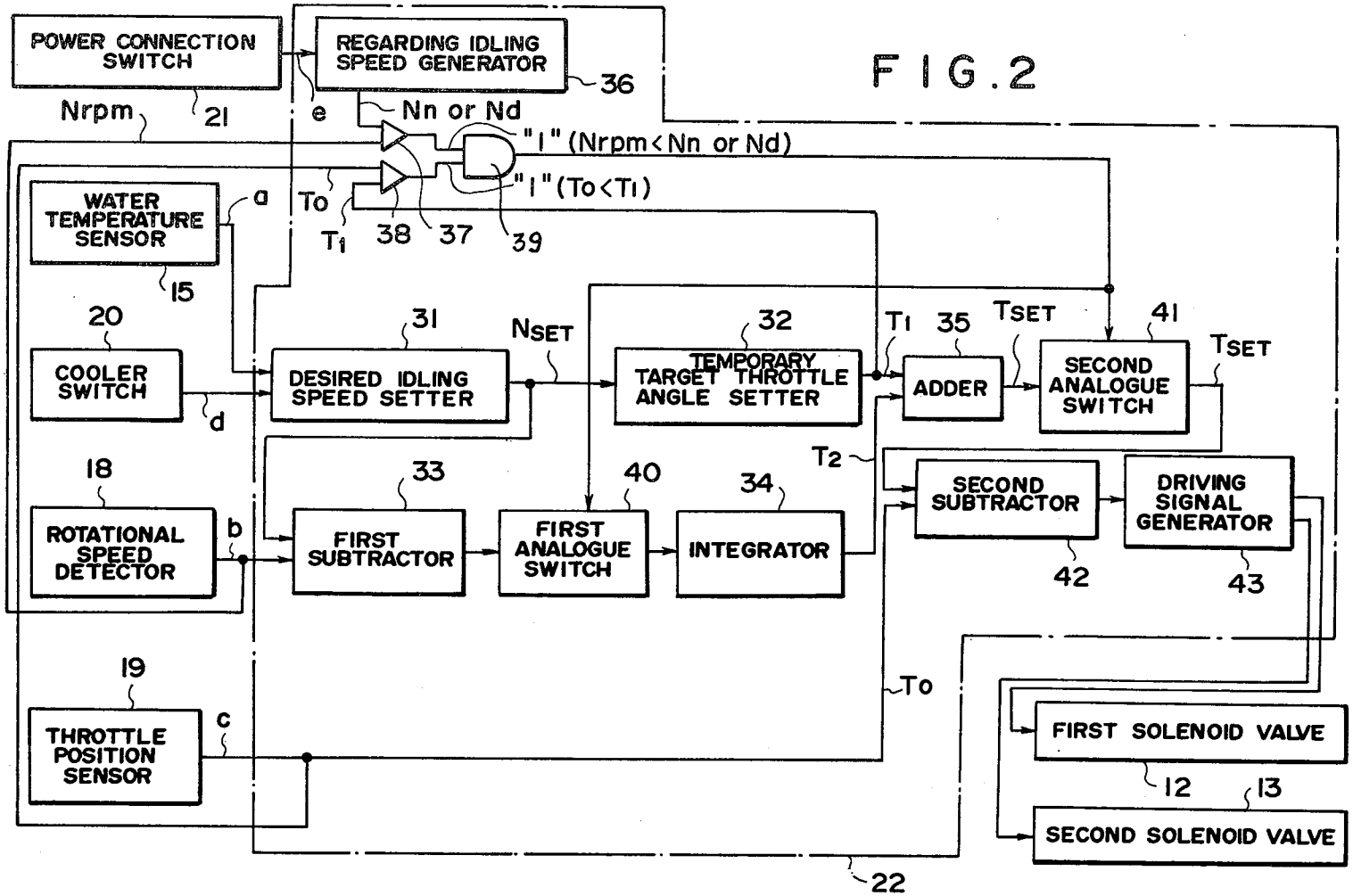
FIG. 2 is a block diagram of an example of an actuator controlling device which can be used in the idling speed controlling system of FIG. 1, FIG. 3(*a*) is a graph showing the relationship between the temperature of the cooling water and the desired idling speed in case of the embodiment of FIG. 1, FIG. 3(*b*) is a graph showing the relationship between the temporary target opening angle of the throttle valve and the desired idling speed, FIG. 3(*c*) is a graph showing the relationship between the duty ratio of the solenoid valve driving signal and the difference between the target opening angle of the throttle valve and the actual opening angle of the same, FIG. 4(*a*) is a flow chart of the CPU employed in the idling controlling system of FIG. 1, FIG. 4(*b*) is a view showing in detail a subflow of the flow chart of FIG. 4(*a*), FIGS. 5(*a*) to 5(*c*) are views showing the change of the opening angle of the throttle valve, the change of the rotational speed of the engine and the operating conditions of the engine, respectively.

FIG. 2 is a block diagram of an example of the actuator controlling device. In FIG. 2, like parts and like signals bear the same reference numerals or symbols as those in FIG. 1. In FIG. 2 the part surrounded by the chained line corresponds to the microcomputer in FIG. 1 as indicated at 22. A desired idling speed setter 31 determines a desired idling speed Nset according to the water temperature signal a and the cooler load signal d in accordance with the relationship shown in FIG. 3(*a*). A desired throttle angle setter 32 determines a temporary target opening angle T1 of the throttle valve 7 according to the desired idling speed Nset in accordance with the relationship shown in FIG. 3(*b*). The difference between the desired idling speed Nset and the actual rotational speed Nrpm of the engine 1 is calculated by a first subtractor 33. An integrator 34 integrates the output of the subtractor 33 to obtain a correction term T2 for a target opening angle Tset of the throttle valve 7. An adder 35 adds the correction term T2 to the temporary target opening angle T1 to obtain the target opening angle Tset of the throttle valve 7. A reference idling speed generator 36 generates a first reference idling speed Nn below which the engine 1 is considered to be idling when the driving power is in said non-transmitted state or a second reference idling speed Nd below which the engine 1 is considered to be idling when the driving power is in said transmitted state depending on the power transmission signal e from the driving power transmission detecting switch 21, the first reference idling speed Nn being higher than the second reference idling speed Nd. A first comparator 37 compares the actual rotational speed Nrpm with the generated reference idling speed (Nn or Nd) and outputs "1" when the former is smaller than the latter. A second comparator 38 compares the actual opening angle T0 of the throttle valve 7 with the temporary target opening angle T1 of the same and outputs "1" when the former is smaller than the latter. The outputs of the first and second comparators 37 and 38 are inputted into an AND circuit 39. A first analogue switch 40 is inserted between the subtractor 33 and the integrator 34 to receive the output of the AND circuit 39 and transmits the output of the subtractor 33 to the integrator 34 when output of the AND circuit 39 is "1". A second analogue switch 41 is connected between the adder 35 and a second analogue switch 42. The second analogue switch 41 receives the output of the AND circuit 39 and transmits the output of the adder 35, i.e., the target opening angle Tset, to the second subtractor 42 when the output of the AND circuit 39 is "1". The second subtractor 42 calculates the difference between the target opening angle Tset and the actual opening angle T0 of the throttle valve 7. A driving signal generator 43 generates a pulse signal having a desired duty ratio for driving the solenoid valve 12 or 13 according to the output [Tset−T0] of the subtractor 42 in accordance with the relationship shown in FIG. 3(*c*).

Now, operation of the controlling system of FIG. 1 will be described referring to FIG. 4 which shows a flow chart of operation of the CPU 22*c*.

In step S1, the CPU 22*c* first determines the operating condition of the engine 1 based on the water temperature signal a representing the temperature of the cooling water and the cooler load signal d representing whether or not the cooler is in operation. In step S2, the desired idling speed Nset is calculated according to the determined operating condition of the engine in accordance with the relationship shown in FIG. 3(*a*). As can be seen from FIG. 3(*a*), when the temperature of the cooling water is low, the desired idling speed Nset is set at a high value. This is because when the ambient temperature is low, idling cannot be stabilized unless the rotational speed of the engine is higher than a certain value. When the cooler is in operation, the desired idling speed is set at a value higher than when the cooler is not in operation in order to assure the efficiency of the cooler, to reduce vibration of the engine and to assure that the dynamo can generate sufficient electric current to operate the cooler.

Figure 3:
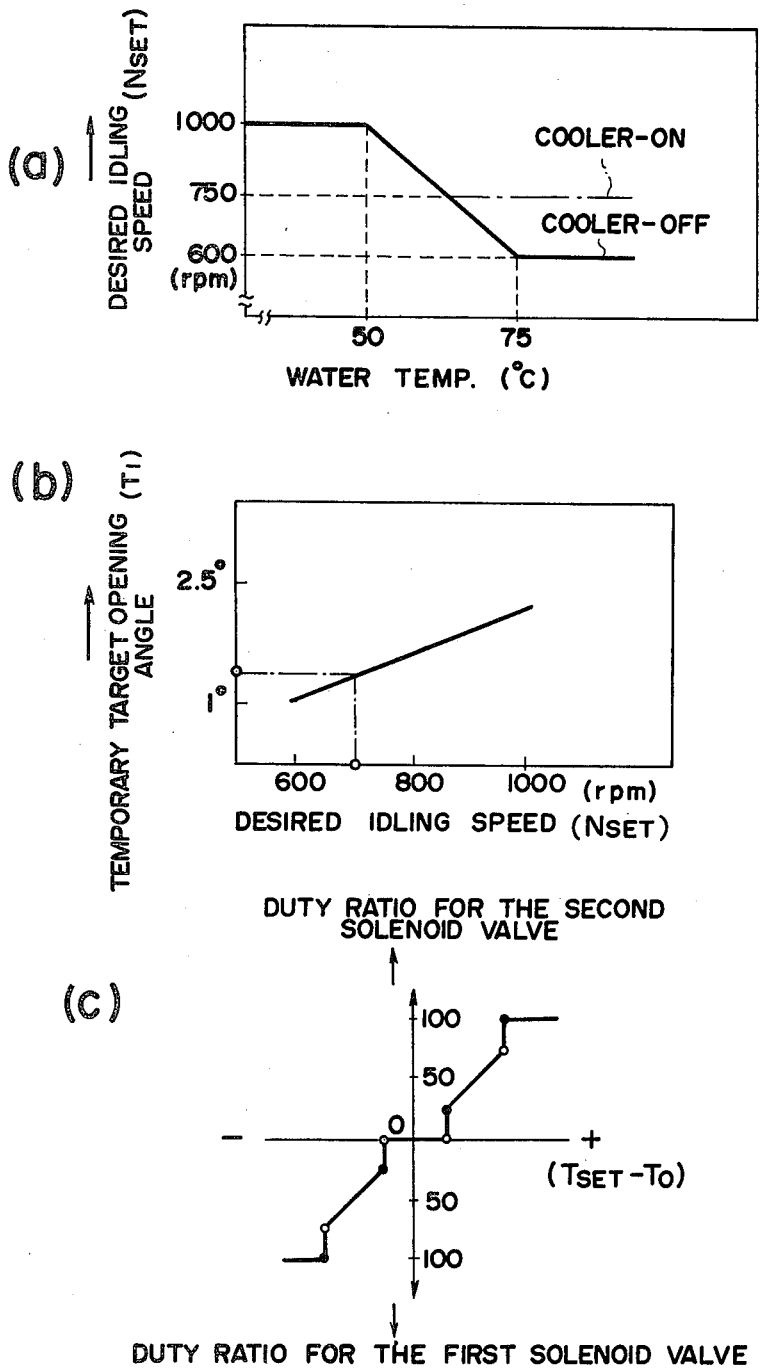

In the next step S3, the desired opening angle T1 of the throttle valve 7 corresponding to the desired idling speed Nset is obtained in accordance with the relationship shown in FIG. 3(*b*). Then, in step 4 the actual opening angle T0 of the throttle valve 7 is detected through the throttle opening angle signal c. In step 5, the actual rotational speed of the engine is detected through the rotational speed signal b. Thereafter, the operation of the CPU 22*c* proceeds to subflow S6 for determining whether or not the engine is idling. In the subflow S6 shown in FIG. 4(*b*), the actual opening angle T0 of the throttle valve 7 is compared, in step S61, with the temporary target opening angle T1 to determine whether or not the former is smaller than the latter. If NO, i.e., if the actual opening angle T0 is not smaller than the temporary target opening angle T1, it is determined that the engine is not idling, and the operation of the CPU is immediately returned to the start in FIG. 4(*a*). If YES, i.e., if the actual opening angle T0 is smaller than the temporary target opening angle T1, the CPU 22*c* proceeds to step S62 to determine whether or not the driving power is in the non-transmitted state through the power transmission signal e. If YES, i.e., if the driving power is in the non-transmitted state, the CPU 22*c* proceeds to step S63, otherwise the CPU 22*c* proceeds to step S64. In the step S63, the actual rotational speed Nrpm is compared with the first reference idling speed Nn for the non-transmitted state to determine whether or not the former is lower than the latter. If YES, the CPU 22*c* proceeds to step S7 while if NO, the CPU 22*c* returns to the start. In the step S64, the actual rotational speed Nrpm is compared with the second reference idling speed Nd for the transmitted state to determine whether or not the former is lower than the latter. If YES, the CPU 22*c* proceeds to step S7, while if NO, the CPU 22*c* returns to the start.

Thus, in the subflow S6, when the driving power is in the non-transmitted state, it is determined that the engine is idling even if the actual rotational speed Nrpm is higher than the second reference idling speed Nd for the transmitted state.

In the step S7, the difference between the desired idling speed Nset and the actual rotational speed Nrpm is multiplied by a constant k to obtain the correction term T2 for the target opening angle Tset of the throttle valve 7, i.e., T2=k (Nset−Nrpm). When the CPU 22*c* repeats the entire flow chart of FIG. 4, the previous correction term is added to the newly obtained correction term. Thus, in this case, the sum T2' of the newly obtained correction term T2 and the previous correction term is used as the correction term. In step S8, the correction term T2 or T2' is added to the temporary target opening angle T1 to obtain the target opening angle Tset. Finally, in step S9, the difference between the temporary target opening angle Tset and the actual opening angle T0 is calculated and a pulse signal having a duty ratio which is determined in accordance with the relationship shown in FIG. 3(*c*) according to the difference is outputted as the driving signal for the solenoid valves 12 and 13.

Figure 4:
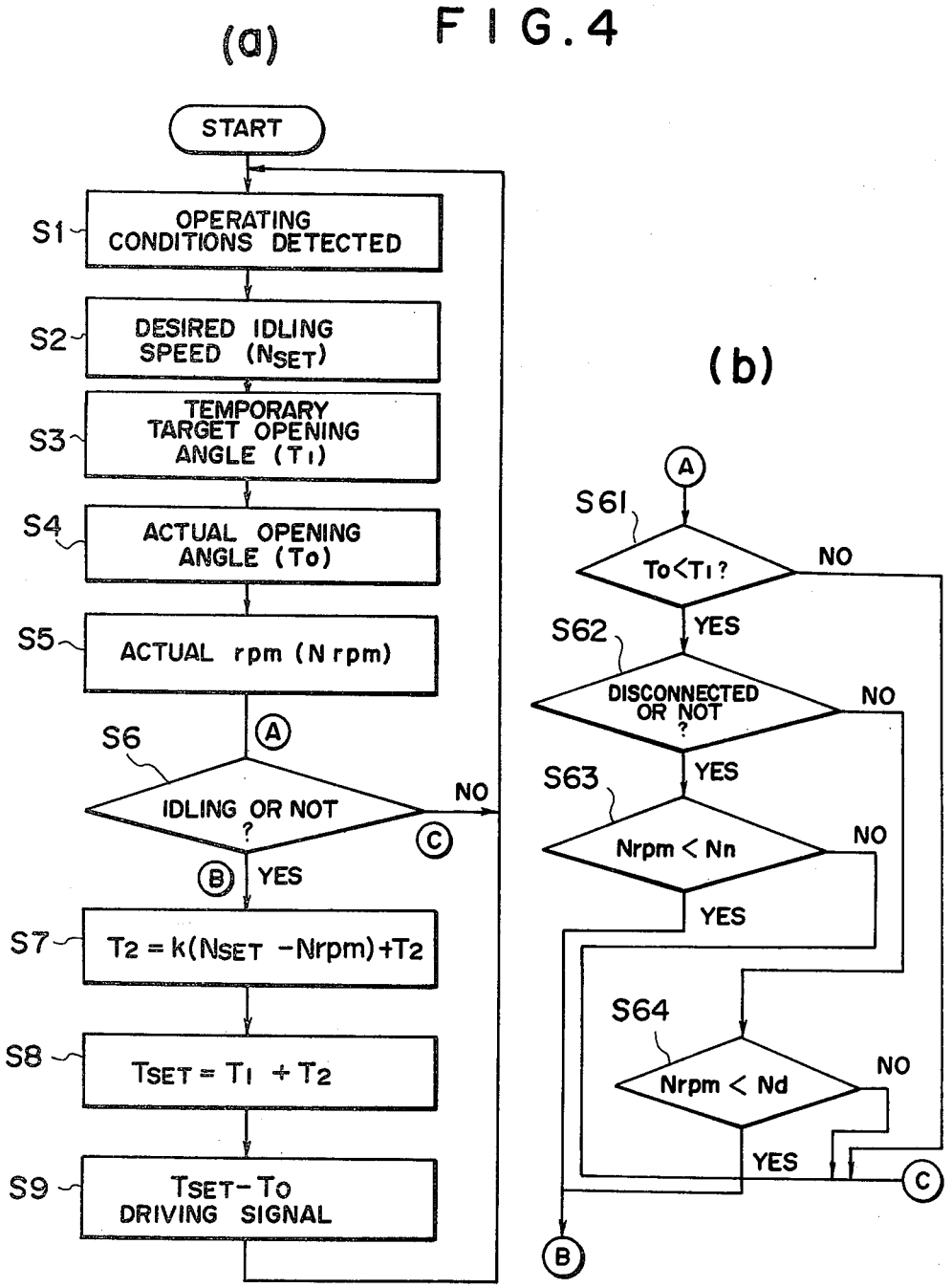

Generally the CPU 22*c* repeats the entire processing shown in FIG. 4 at rate of once in about 30 msec.

Figure 5:
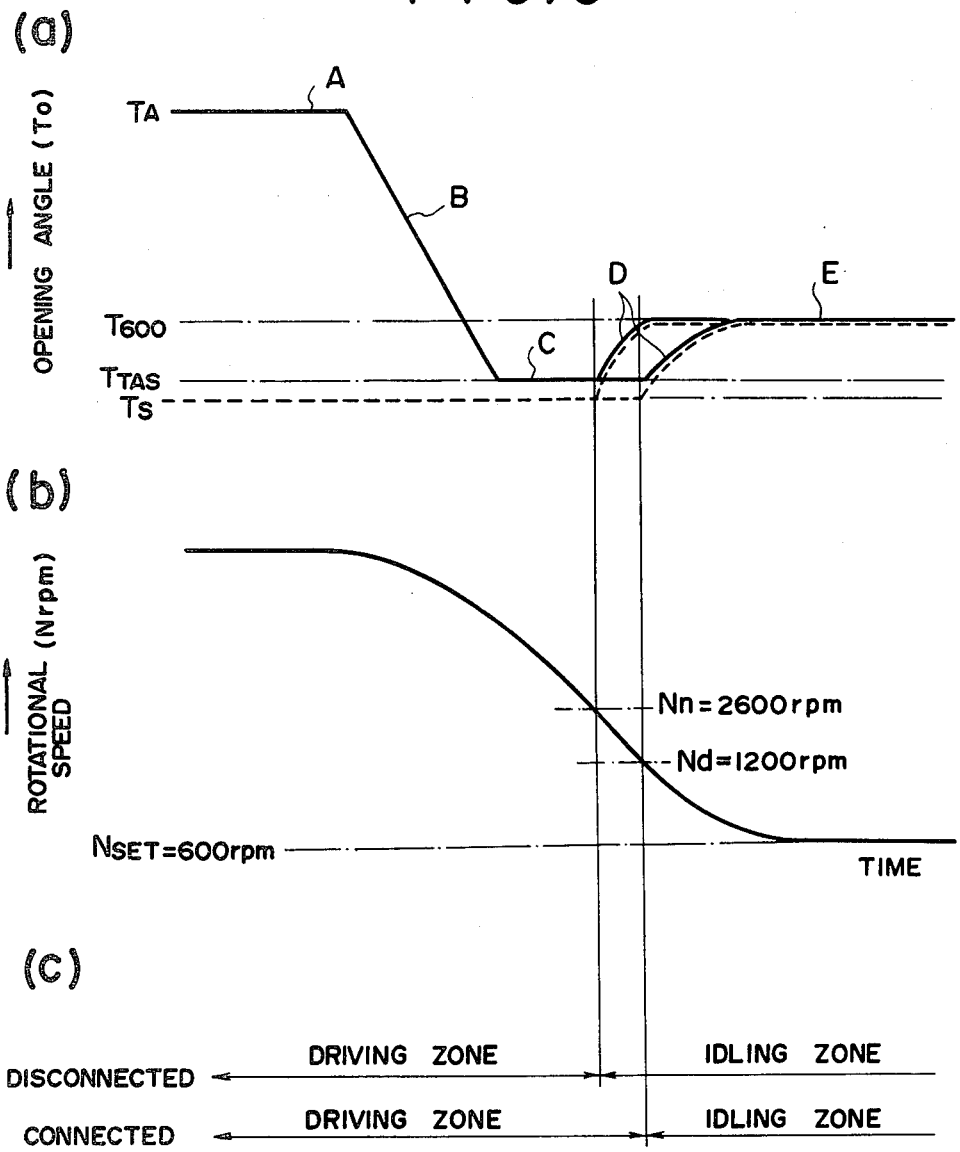

Now operation of the system of FIG. 1 will be described assuming, by way of example, that the actual opening angle of the throttle valve and the actual rotational speed of the engine change as shown in FIG. 5.

In FIG. 5, in region A in which the actual opening angle T0 of the throttle valve is at a large value TA, the actual rotational speed Nrpm of the engine is at a high value and accordingly the idling speed control is not carried out irrespective of the state of the power transmission. As the actual opening angle T0 of the throttle valve is gradually reduced as in region B, the actual rotational speed Nrpm of the engine gradually lowers. However, while the actual opening angle T0 is larger than the temporary target opening angle T600 corresponding to the desired idling speed Nset=600 rpm in the idling zone, the engine is still in the driving zone. Even if the actual opening angle T0 becomes smaller than the temporary target opening angle T600 corresponding to said desired idling speed (600 rpm), and even if the actual opening angle T0 becomes still smaller to reach, as in region C, the lower limit or the so-called TAS opening angle which is the minimum value of the opening angle of the throttle valve defined by the throttle adjust screw, the engine is considered to be still in the driving zone until the actual rotational speed Nrpm becomes not higher than the reference idling speed Nn (Nn=2600 rpm in this particular embodiment) or Nd (Nd=1200 rpm in this particular embodiment), and therefore, the opening angle of the throttle valve is kept at the TAS opening angle $T_{TAS}$. When the actual rotational speed Nrpm becomes lower than the reference idling speed Nn or Nd, the engine is considered to be in the idling zone and the idling speed control system of this embodiment begins to operate. That is, the CPU 22*c* feeds the driving signal to the second solenoid valve 13 to open the second passage 11 whereby the diaphragm 9*b* is moved leftwardly in FIG. 1 under the suction force imparted thereto through the second passage 11 to move the stopper 8 as shown by the broken line Ts in region D in FIG. 5. As the stopper 8 is moved leftwardly in FIG. 1, the opening angle of the throttle valve 7 is increased as shown in the region D. When the opening angle of the throttle valve 7 becomes equal to the temporary target opening angle T600, the stopper 8 is stopped to hold the throttle valve in this position. The rotational speed of the engine continues to fall until it becomes equal to the desired idling speed Nset (600 rpm) defined by the opening angle T600 at which the opening angle of the throttle valve 7 is kept.

Now an example of the power transmission detecting switch 21 will be described referring to FIG. 6.

Figure 6:
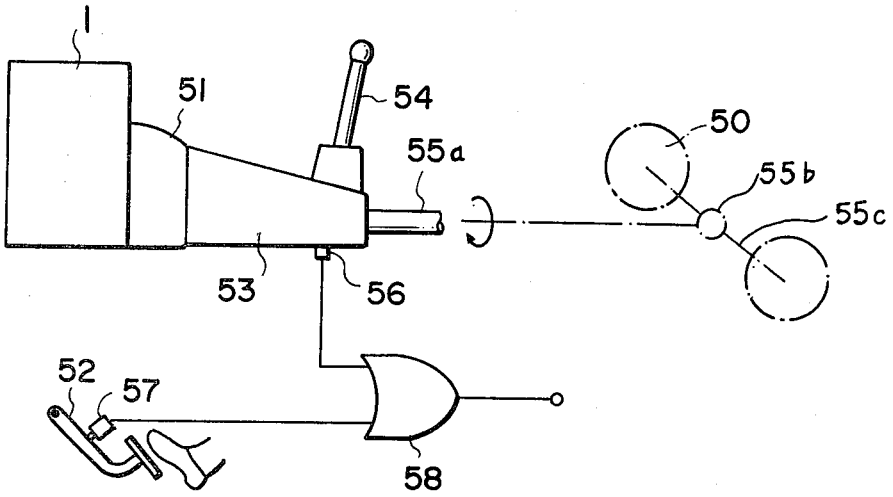
FIG. 6 is a schematic view showing an example of the driving power transmission detecting switch which can be employed in the idling speed controlling system of FIG. 1.

In FIG. 6, the driving power of the engine 1 is transmitted to the driving wheels 50 by way of a clutch mechanism 51 operated by a clutch pedal 52, a transmission 53 operated by a gear-shift lever 54, a propeller shaft 55*a*, a differential 55*b* and drive shafts 55*c*. The driving power transmission switch of this example comprises a neutral position detecting switch 56 which outputs "1" when the gear-shift level 54 is in the nuetral position, a clutch pedal switch 57 which outputs "1" when the clutch pedal 52 is depressed, and an OR circuit 58 which receives the outputs of the neutral position detecting switch 56 and the clutch pedal switch 57. The OR circuit 58 outputs "1" representing that the driving power of the engine 1 is not transmitted to the driving wheels 50, i.e., that the driving power is in the non-transmitted state, when at least one of the outputs of the switches 56 and 57 is "1". Otherwise, the OR circuit 58 outputs "0" representing that the driving power is in the transmitted state. The clutch pedal switch 57 may be one responsive to the movement of the clutch pedal 52 or to the movement of the parts associated therewith. Similarly, the neutral position detecting switch 56 may be one responsive to the movement of the gear-shift lever 54 or to the movement of the parts associated therewith.

In case of an automatic transmission type car, the driving power transmission switch 21 may simply comprise a single switch which is responsive to the movement of the shift lever, to the movement of the parts associated therewith or the oil pressure in the transmission.

As fully described above, in the idling speed control system of the embodiment shown in FIG. 1, whether or not the engine is idling is determined taking into account both the opening angle of the throttle valve and the rotational speed of the engine, and at the same time the reference idling speed below which the engine is considered to be idling is set at a higher value when the driving power of the engine is not transmitted to the driving wheels than when the driving power is transmitted to the driving wheels. Therefore, even if the rotational speed of the engine is abruptly lowered after racing without the driving power being transmitted to the driving wheels, the rotational speed can be rapidly increased by the feedback control, whereby stalling of the engine can be prevented. Further, in this embodiment the engine is not considered to be idling and therefore the opening angle of the throttle valve is not controlled until the rotational speed of the engine becomes sufficiently low even if the actual opening angle is smaller than the desired opening angle corresponding to the desired idling speed while the engine is operated to take advantage of its braking effect. Therefore, there is no possibility of the braking effect of the engine being reduced by the throttle valve being prematurely opened wide.

The operation of the actuator controlling device shown in FIG. 2 is substantially the same as the operation of the microcomputer described above. Therefore, it will not be described in detail.

Although the desired opening angle T1 used as one of the standards for determining whether or not the engine is idling in the above embodiment, the target opening angle Tset of the previous processing may be used instead of the desired opening angle T1.

Further, in the above embodiment the deviation of the actual rotational speed from the desired idling speed is reflected in the deviation of the actual opening angle of the throttle from the target opening angle and the feedback control is carried out to equalize the actual opening angle to the target opening angle. However, the present invention can also be applied to a system in which feedback control is not carried out with respect to the opening angle of the throttle valve and feedback control is carried out with respect only to the rotational speed of the engine.

Further in the above embodiment, the idling speed is controlled by controlling the opening angle of the throttle valve. However, the present invention can be applied to a system in which the idling speed is controlled by controlling the flow of air through a bypass passage bypassing the throttle valve.

Figure 7:
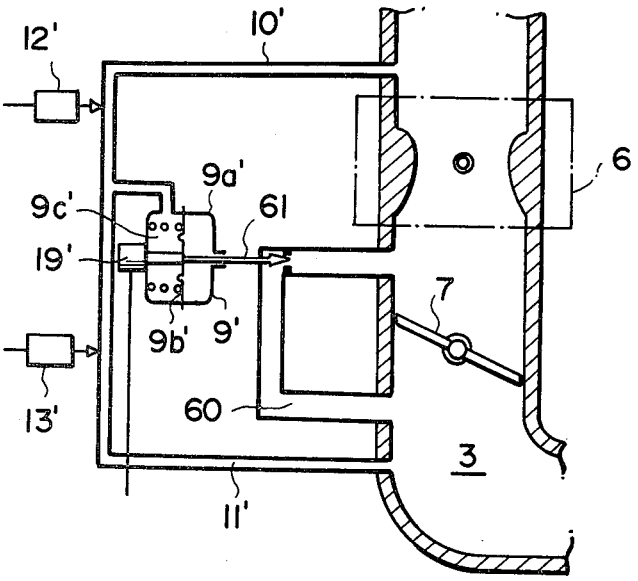
FIG. 7 is a schematic view showing a part of an idling speed controlling system in accordance with another embodiment of the present invention.

In FIG. 7, a bypass passage 60 is provided so that one end thereof opens into the intake manifold 3 between the caburretor 6 and the throttle valve 7, and the other end thereof opens into the intake manifold 3 downstream of the throttle valve 7. A bypass valve 61 is provided in the bypass passage 60 to open and close the bypass passage 60 to control the amount of the air flowing therethrough. The bypass valve 61 is controlled by a diaphragm device 9' which is substantially the same as the diaphragm device 9 in FIG. 1 in its structure and includes a casing 9*a*', diaphragm 9*b*' and a vacuum chamber 9*c*'. A first passage 10' connects the vacuum chamber 9*c*' to the space upstream of the caburretor 6 in the intake manifold 3, while a second passage 11' connects the vacuum chamber 9*c*' to the space downstream of the throttle valve 7 in the induction manifold 3. First and second solenoid valves 12' and 13' are provided to open and close the first and second passages 10' and 11', respectively. Further, a position sensor 19' is provided to detect the position of the bypass valve 61. This system can be controlled in a manner identical to that of the system of FIG. 1 and the signals taken out from or fed to the position sensor 19' and solenoid valves 12' and 13' may be identical to those taken out from or fed to the position sensor 19 and solenoid valves 12 and 13 in FIG. 1, respectively.

We claim:

1. An idling speed controlling system for an internal combustion engine having an intake system, an exhaust system, and a throttle valve disposed in the intake system, the driving power of the engine being adapted to be transmitted to driving wheels by way of a transmission mechanism, comprising a rotational speed detecting means for generating a rotational speed signal representing the actual rotational speed of the engine; a throttle position sensor which detects the position of the throttle valve and generates a throttle signal when the opening degree of the throttle valve is smaller than a predetermined valve; a power transmission detecting means for generating a power transmission signal representing whether or not the driving power of the engine is transmitted to the driving wheels; an actuator means for controlling an adjusting valve which controls the amount of air to be fed to the engine to control the rotational speed of the engine; and a control circuit which receives said signals and includes a speed comparing means which compares a desired idling speed determined according to the operating conditions of the engine with the actual rotational speed of the engine detected by the rotational speed detecting means and outputs the difference therebetween, a control signal generating means which generates a control signal according to the output of the speed comparing means for controlling the actuator means to drive the adjusting valve so that the difference between the desired idling speed and the actual rotational speed of the engine is nullified, and an operation control means which causes the control signal generating means and the speed comparing means to operate when the engine is determined to be idling, the engine being determined to be idling in case that the driving power of the engine is not transmitted to the driving wheels, when the opening degree of the throttle valve is smaller than the predetermined valve and at the same time the actual rotational speed is lower than a first predetermined speed, while in case that the driving power is transmitted to the driving wheels, when the opening degree of the throttle valve is smaller than the predetermined valve and at the same time the actual rotational speed is lower than a second predetermined speed which is lower than the first predetermined speed, said first and second predetermined speeds being higher than said desired idling speed.

2. An idling speed controlling system as defined in claim 1 in which said transmission mechanism includes a transmission operated by a gear-shift lever, a clutch mechanism operated by a clutch pedal and a driving shaft, and said power transmission detecting means includes means for detecting the position of the gear-shift lever and means for detecting whether or not the clutch pedal is depressed and generates a signal representing that the driving power of the engine is not transmitted to the driving wheels when the gear-shift lever is in the neutral position and/or the clutch pedal is depressed.

3. An idling speed controlling system as defined in claim 1 in which said transmission mechanism includes a transmission and a driving shaft, and said power transmission detecting means detects whether or not the transmission is operatively connected to the driving shaft.

4. An idling speed controlling system as defined in claim 3 further comprising a valve position sensor for generating a valve position signal representing the opening degree of the adjusting valve in which said control signal generating means comprises a target valve position setting means for generating a target valve position signal representing a target valve position during which is determined based on the output of said comparing means, a valve position comparing means which compares the actual position of the adjusting valve detected by the valve position sensor with the target valve position determined by the target valve position setting means and outputs the difference therebetween, and a signal generating means for generating said control signal which controls said actuator means to drive the adjusting valve so that the difference between the actual position and the target valve position is nullified, whereby the difference between the desired idling speed and the actual rotational speed of the engine is nullified.

5. An idling speed controlling system as defined in claim 4 in which said target valve position setting means includes a temporary target valve position setting means for generating a temporary target valve position signal representing a temporary target valve position which is preset for obtaining said desired idling speed, and an adder which adds the temporary target position signal to the output of the speed comparing means and generates a target valve position signal representing the target valve position.

6. An idling speed controlling system as defined in claim 5 in which said adjusting valve is the throttle valve, and said valve position sensor is the throttle position sensor.

7. An idling speed controlling system as defined in claim 6 in which said predetermined value for the opening degree of the throttle valve is the opening degree of the throttle valve corresponding to said desired throttle position.

8. An idling speed controlling system as defined in claim 7 in which said actuator means includes a stopper which engages with the throttle valve to open and close it, the throttle valve being urged to close the intake system and the minimum opening degree of the throttle valve being defined by the stopper, a diaphragm device having a diaphragm and a pressure chamber defined by the diaphragm, said stopper being connected to the diaphragm to be moved together with the diaphragm according to the pressure in the pressure chamber, and a solenoid valve which controls the pressure in the pressure chamber of the diaphragm device under control of said control signal.

9. An idling speed controlling system as defined in claim 5 in which said adjusting valve is a bypass valve disposed in a bypass passage provided to bypass the throttle valve in the intake system.

10. An idling speed controlling system as defined in claim 9 in which said actuator means included a connecting member which is connected with the bypass valve to open and close it, a diaphragm device having a diaphragm and a pressure chamber defined by the diaphragm, said connecting member being connected to the diaphragm to be moved together with the diaphragm according to the pressure in the pressure chamber, and a solenoid valve which controls the pressure in the pressure chamber of the diaphragm device under control of said control signal.

* * * * *

UNITED STATES PATENT AND TRADEMARK OFFICE

CERTIFICATE OF CORRECTION

PATENT NO. : 4,474,153

DATED : October 2, 1984

INVENTOR(S) : Masato HANAMOTO, et al.

It is certified that error appears in the above-identified patent and that said Letters Patent is hereby corrected as shown below:

In the heading of the patent, [73] Assignee:, delete "Toyo Kogyo Co., Ltd." and insert therefor -- Mazda Motor Corporation -- .

Signed and Sealed this

*Twenty-sixth* Day of *March 1985*

[SEAL]

*Attest:*

DONALD J. QUIGG

*Attesting Officer*

*Acting Commissioner of Patents and Trademarks*